US010461479B2

(12) United States Patent
Wei et al.

(10) Patent No.: US 10,461,479 B2
(45) Date of Patent: Oct. 29, 2019

(54) ELECTROMAGNETIC SHIELDING ELASTIC CLIP AND CONNECTOR HOUSING INCLUDING THE SAME

(71) Applicant: Tyco Electronics (Zhuhai) Ltd, Zhuhai (CN)

(72) Inventors: Jikang Wei, Zhuhai (CN); Qiang Yu, Zhuhai (CN); Shufeng Jia, Zhuhai (CN)

(73) Assignee: Tyco Electronics (Zhuhai) Ltd, Zhuhai (CN)

( * ) Notice: Subject to any disclaimer, the term of this patent is extended or adjusted under 35 U.S.C. 154(b) by 0 days.

(21) Appl. No.: 16/002,464

(22) Filed: Jun. 7, 2018

(65) Prior Publication Data

US 2018/0358754 A1 Dec. 13, 2018

(30) Foreign Application Priority Data

Jun. 8, 2017 (CN) ..... 2017 2 0661256 U

(51) Int. Cl.
*H01R 13/659* (2011.01)
*H01R 13/6594* (2011.01)
*H01R 43/18* (2006.01)

(52) U.S. Cl.
CPC ..... *H01R 13/659* (2013.01); *H01R 13/6594* (2013.01); *H01R 43/18* (2013.01)

(58) Field of Classification Search
CPC ..... H01R 13/65802; H01R 13/658; H01R 13/622; H01R 23/6873; H01R 13/659; H01R 13/6594; H01R 43/18
USPC ..... 439/607.2, 607.21, 607.17, 607.19
See application file for complete search history.

(56) References Cited

U.S. PATENT DOCUMENTS

| | | | | |
|---|---|---|---|---|
| 4,812,137 | A * | 3/1989 | Wilson | H01R 13/6582 439/607.17 |
| 6,997,722 | B2 * | 2/2006 | Mangold | H01R 4/66 439/92 |
| 7,001,217 | B2 * | 2/2006 | Bright | G02B 6/4201 439/607.2 |
| 7,869,224 | B1 * | 1/2011 | Yang | G02B 6/4284 174/350 |
| 2003/0172433 | A1 * | 9/2003 | Young | A41D 27/02 2/97 |
| 2007/0212942 | A1 * | 9/2007 | Long | G02B 6/4201 439/607.17 |
| 2015/0121800 | A1 * | 5/2015 | Cipriani | E04B 9/10 52/848 |

* cited by examiner

*Primary Examiner* — Gary F Paumen
(74) *Attorney, Agent, or Firm* — Barley Snyder

(57) ABSTRACT

An electromagnetic shielding elastic clip comprises a first elastic sheet and a second elastic sheet. The first elastic sheet has a first passageway disposed at an end of the first elastic sheet. The second elastic sheet has a second passageway disposed at an end of the second elastic sheet and aligned with the first passageway. A diameter of the first passageway is larger than a diameter of the second passageway and an edge portion of the second passageway is bent onto an edge portion of the first passageway such that the edge portion of the second passageway and the edge portion of the first passageway are riveted to each other.

14 Claims, 4 Drawing Sheets

ELECTROMAGNETIC SHIELDING ELASTIC CLIP AND CONNECTOR HOUSING INCLUDING THE SAME

CROSS-REFERENCE TO RELATED APPLICATIONS

This application claims the benefit of the filing date under 35 U.S.C. § 119(a)-(d) of Chinese Patent Application No. 201720661256.6, filed on Jun. 8, 2017.

FIELD OF THE INVENTION

The present invention relates to an electrical connector and, more particularly, to an electromagnetic shielding elastic clip for an electrical connector.

BACKGROUND

In order to improve electromagnetic shielding of a high-speed connector against electromagnetic interference, an electromagnetic shielding elastic clip is commonly disposed on each of four walls of an insertion port of a housing of the connector. The electromagnetic shielding elastic clip generally includes a first elastic sheet and a second elastic sheet. The bases of the first and second elastic sheets are connected to form a U-shaped elastic clip, and the U-shaped elastic clip is clamped on a side wall of the housing. The ends of the first and second elastic sheets are received in an opening in the side wall of the housing and are welded to each other. The first and second elastic sheets each further have an arc-shaped elastic contact portion between the base and the end.

When the arc-shaped elastic contact portion is pressed, the mutually welded ends of the first and second elastic sheets move back and forth in the opening in the side wall of the housing and will not separate from each other. However, because it is necessary to weld the ends of the first and second elastic sheets to each other, the mounting efficiency of the electromagnetic shielding elastic clip is reduced. In addition, because the thickness of the first and second elastic sheets is very thin, welding is very difficult, which results in poor welding quality, low reliability, and a high defect rate.

SUMMARY

An electromagnetic shielding elastic clip comprises a first elastic sheet and a second elastic sheet. The first elastic sheet has a first passageway disposed at an end of the first elastic sheet. The second elastic sheet has a second passageway disposed at an end of the second elastic sheet and aligned with the first passageway. A diameter of the first passageway is larger than a diameter of the second passageway and an edge portion of the second passageway is bent onto an edge portion of the first passageway such that the edge portion of the second passageway and the edge portion of the first passageway are riveted to each other.

BRIEF DESCRIPTION OF THE DRAWINGS

The invention will now be described by way of example with reference to the accompanying Figures, of which.

DETAILED DESCRIPTION OF THE EMBODIMENTS

Figure 1:
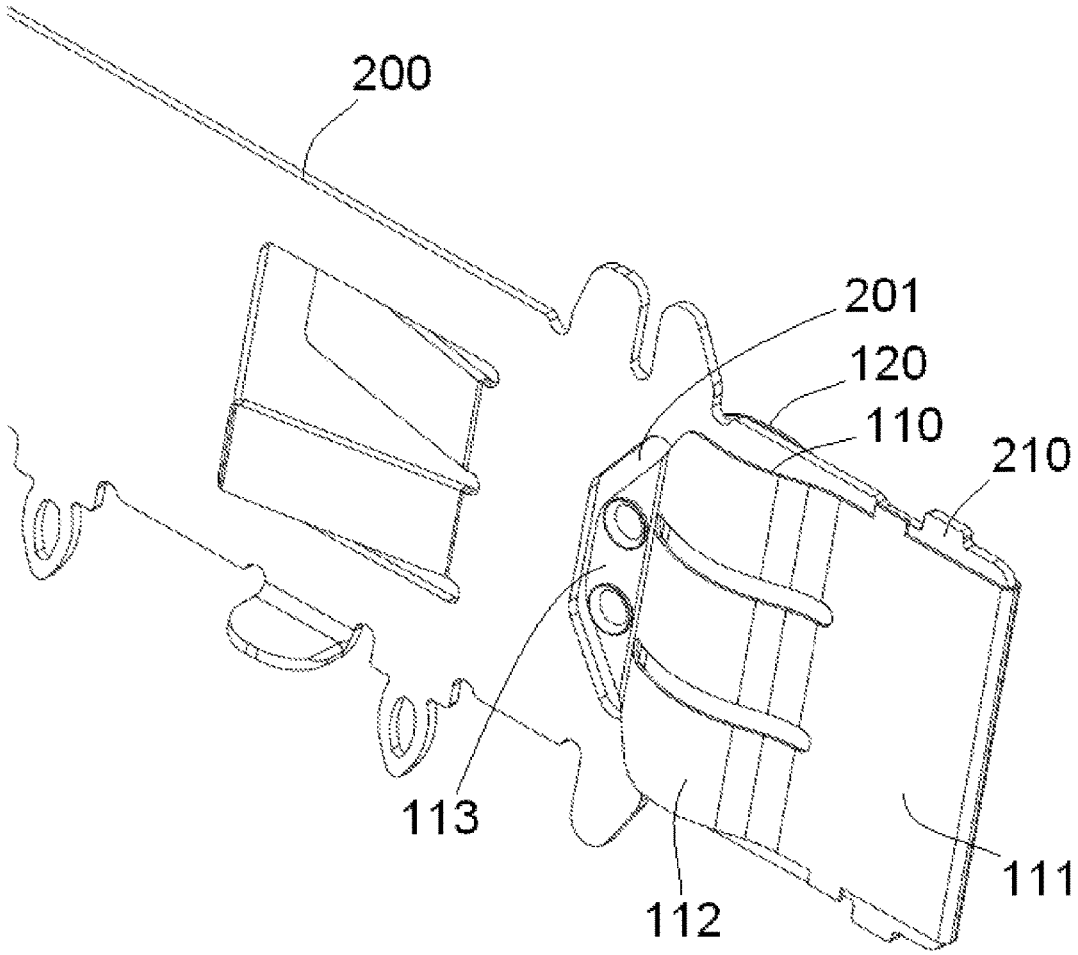
FIG. 1 is a perspective view of an electromagnetic shielding elastic clip according to an embodiment mounted on a partition plate.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

An electromagnetic shielding elastic clip according to an embodiment of the invention is shown in FIGS. 1 and 3-5. The electromagnetic shielding elastic clip includes a first elastic sheet 110 and a second elastic sheet 120. In an embodiment, the electromagnetic shielding elastic clip is formed of a single piece of thin metal plate.

Figure 4:
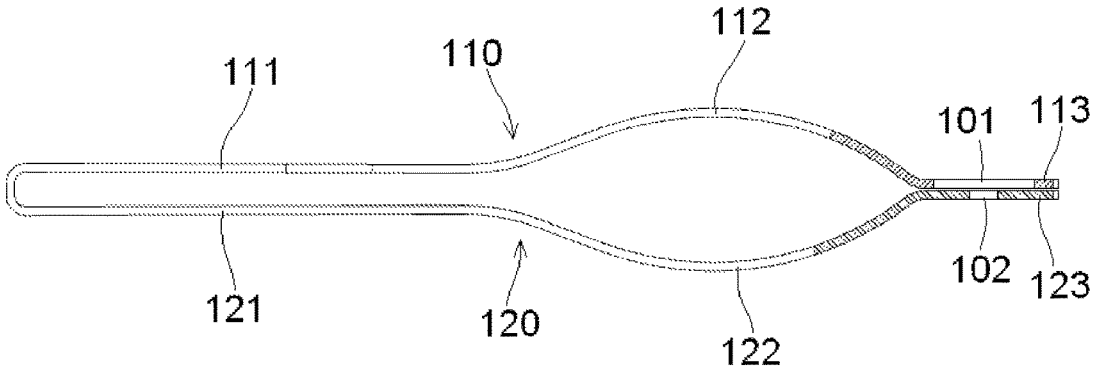
FIG. 4 is a sectional view of the electromagnetic shielding elastic clip before ends of first and second elastic sheets of the electromagnetic shielding elastic clip are riveted.
Figure 5:
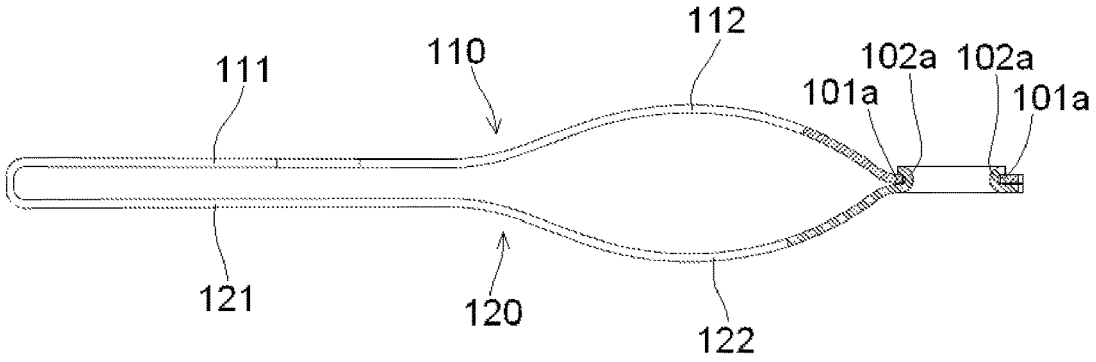
FIG. 5 is a sectional view of the electromagnetic shielding elastic clip after ends of the first and second elastic sheets are riveted.

As shown in FIGS. 4 and 5, a first passageway 101 is disposed at either an end 113 of the first elastic sheet 110 or an end 123 of the second elastic sheet 120. A second passageway 102 aligned with the first passageway 101 is formed at the other of the end 113 of the first elastic sheet 110 and the end 123 of the second elastic sheet 120. A diameter of the first passageway 101 is larger than the diameter of the second passageway 102, and an edge portion 102*a* of the second passageway 102 is turned over onto an edge portion 101*a* of the first passageway 101 so that the first edge portion 101*a* and the edge portion 102*a* of the second passageway 102 are riveted together. In an embodiment, the turning of the edge portion 102*a* of the second passageway 102 is executed by a stamping process, such as by a stamping die.

In the embodiment shown in FIGS. 1-5, a plurality of first passageways 101 are formed at the end 113 of the first elastic sheet 110 and a plurality of second passageways 102 respectively aligned with the plurality of first passageways 101 are formed at the end 123 of the second elastic sheet 120. The edge portions 102*a* of the plurality of second passageways 102 are each turned over onto one of the edge portions 101*a* of the plurality of first passageways 101, respectively, such that the edge portions 101*a* of the plurality of first passageways 101 are respectively riveted to the edge portions 102*a* of the plurality of second passageways 102.

As shown in FIGS. 1, 4, and 5, a first elastic contact portion 112 is formed on the first elastic sheet 110, and the first elastic contact portion 112 is positioned between a base 111 and the end 113 of the first elastic sheet 110. A second elastic contact portion 122 is formed on the second elastic sheet 120 and the second elastic contact portion 122 is positioned between a base 121 and the end 123 of the second elastic sheet 120. In the shown embodiment, the first elastic contact portion 112 and the second elastic contact portion 122 are arc-shaped, and project away from each other in upward and downward directions (opposite directions), respectively.

Figure 6:
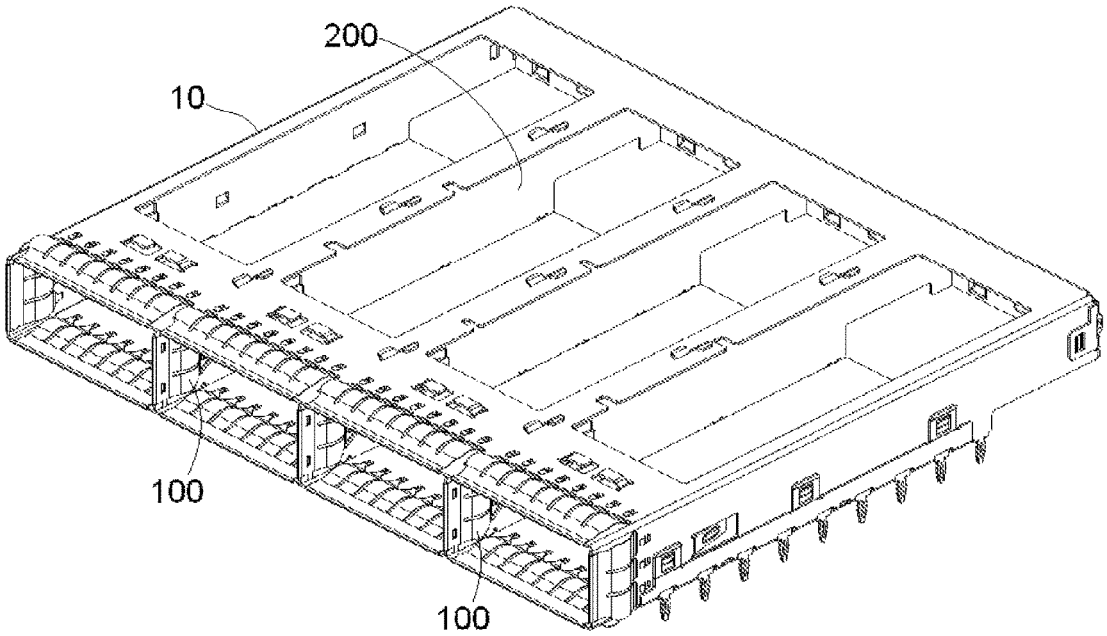
FIG. 6 is a perspective view of a connector housing according to an embodiment.

As shown in FIGS. 1-3 and 6, the electromagnetic shielding elastic clip is mounted on a partition plate 200. The partition plate 200, as shown in FIG. 6, is adapted to divide a frame 10 of a connector housing into two or more ports for plugging mating electrical connector plugs, respectively.

Figure 2:
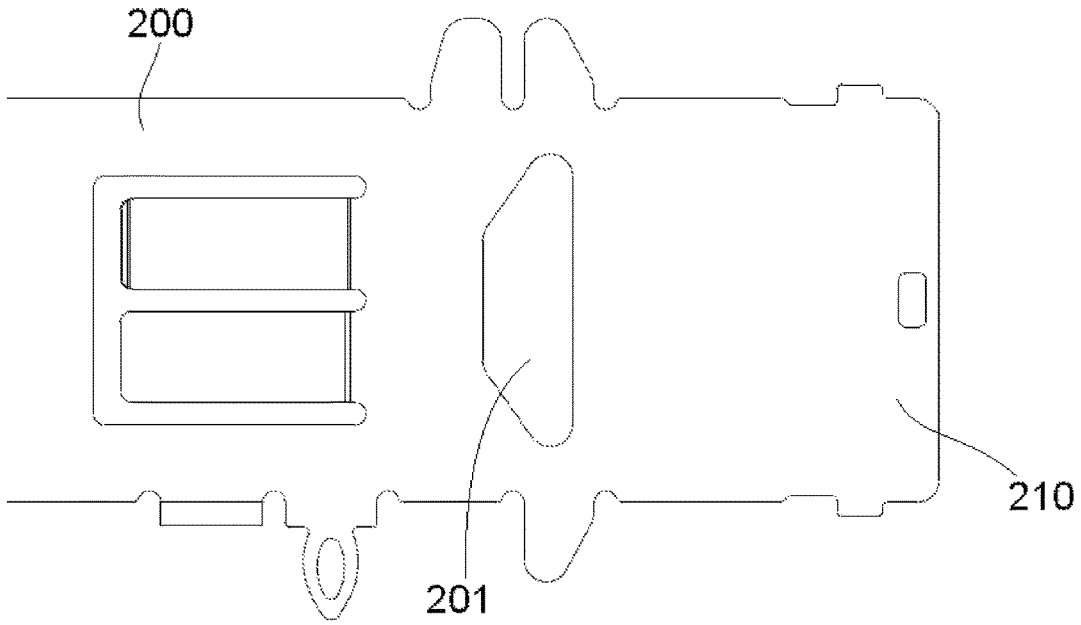
FIG. 2 is a plan view of the partition plate.
Figure 3:
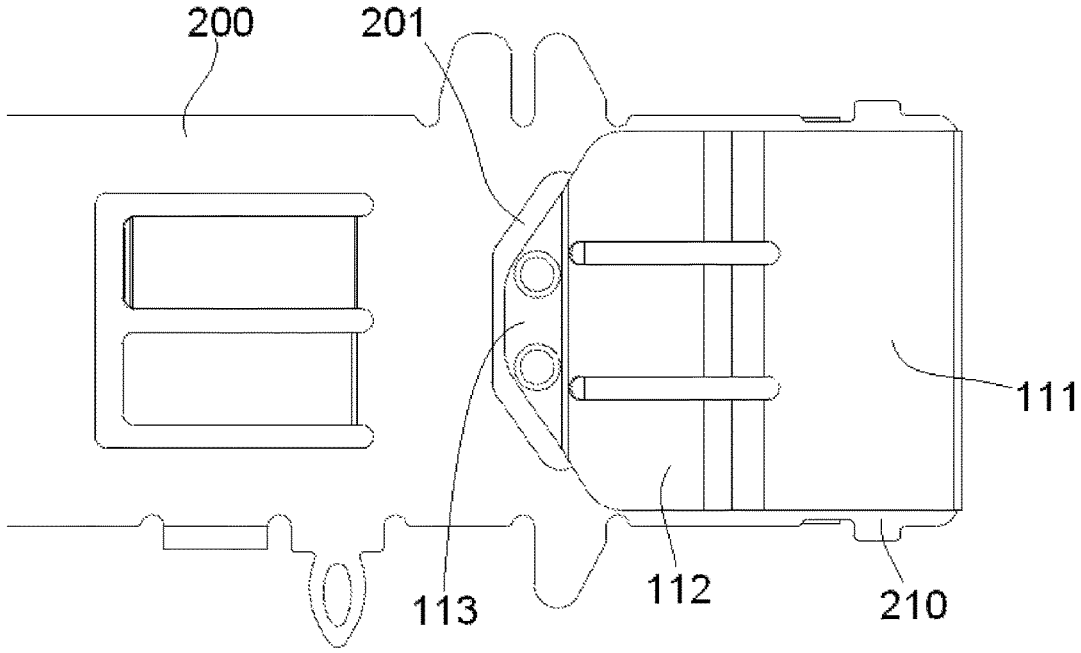
FIG. 3 is a plan view of the electromagnetic shielding elastic clip mounted on the partition plate.

As shown in FIGS. 1-5, the bases 111, 121 of the first and second elastic sheet 110, 120 constitute a U-shaped elastic clip, and the U-shaped elastic clip is adapted to be clamped on an end 210 of the partition plate 200. A notch 201 is formed in the partition plate 200 as shown in FIGS. 1-3. The ends 113, 123 of the first and second elastic sheets 110, 120 are adapted to be received in the notch 201 of the partition plate 200, and the ends 113, 123 of the first and second elastic sheets 110, 120 are riveted together after being received in the notch 201. When the first elastic contact portion 112 and the second elastic contact portion 122 of the electromagnetic shielding elastic clip are compressed, the first elastic contact portion 112 and the second elastic contact portion 122 are elastically deformed such that the ends 113, 123 of the first and second elastic sheets 110, 120 that have been riveted together move back and forth in the notch 201 of the partition plate 200 and cannot be separated.

A connector housing according to an embodiment of the invention is shown in FIG. 6 and comprises a frame 10, the partition plate, and the electromagnetic shielding elastic clip 100 described above. The partition plate 200 divides the frame 10 into two or more ports. The electromagnetic shielding elastic clip 100 is mounted on the partition plate 200 and, as shown in FIG. 1, includes the first elastic sheet 110 on one side of the partition plate 200 and the second elastic sheet 120 on the other side of the partition plate 200. The first elastic sheet 110 and the second elastic sheet 120 are each brought into contact with a metal housing of a mating electrical connector plug to provide electromagnetic shielding of the connector housing.

Advantageously, the ends 113, 123 of the first and second elastic sheets 110, 120 of the electromagnetic shielding elastic clip are directly riveted together by stamping. Thus, the electromagnetic shielding elastic clip may be riveted and assembled together with the partition plate 200 of the connector housing in a stamping die, improving the mounting efficiency of the electromagnetic shielding elastic clip, ensuring the connection reliability of the electromagnetic shielding elastic clip, and prolonging the service life of the electromagnetic shielding elastic clip.

What is claimed is:

1. An electromagnetic shielding elastic clip, comprising:

a first elastic sheet having a base and a first passageway disposed at an end of the first elastic sheet opposite the base of the first elastic sheet; and a second elastic sheet having a base and a second passageway disposed at an end of the second elastic sheet opposite the base of the second elastic sheet, the base of the first elastic sheet and the base of the second elastic sheet form a U-shaped elastic clip, the second passageway is aligned with the first passageway, a diameter of the first passageway is larger than a diameter of the second passageway and an edge portion of the second passageway is bent onto an edge portion of the first passageway such that the edge portion of the second passageway and the edge portion of the first passageway are riveted to each other at an end of the electromagnetic shielding elastic clip opposite the U-shaped elastic clip.

2. The electromagnetic shielding elastic clip of claim 1, wherein a first elastic contact portion is formed on the first elastic sheet between the base of the first elastic sheet and the end of the first elastic sheet.

3. The electromagnetic shielding elastic clip of claim 2, wherein a second elastic contact portion is formed on the second elastic sheet between the base of the second elastic sheet and the end of the second elastic sheet.

4. The electromagnetic shielding elastic clip of claim 3, wherein the first elastic contact portion and the second elastic contact portion each have an arc-shape and project in opposite directions.

5. The electromagnetic shielding elastic clip of claim 1, wherein the U-shaped elastic clip is adapted to be clamped on an end of a partition plate.

6. The electromagnetic shielding elastic clip of claim 5, wherein the end of the first elastic sheet and the end of the second elastic sheet are each received in a notch of the partition plate.

7. The electromagnetic shielding elastic clip of claim 6, wherein the end of the first elastic sheet and the end of the second elastic sheet are riveted to each other after being received in the notch.

8. The electromagnetic shielding elastic clip of claim 1, wherein the electromagnetic shielding elastic clip is formed of a single piece of a thin metal plate.

9. The electromagnetic shielding elastic clip of claim 1, wherein a plurality of first passageways are disposed at the end of the first elastic sheet and a plurality of second passageways are disposed at the end of the second elastic sheet, each of the plurality of second passageways are aligned with one of the plurality of first passageways.

10. A connector housing, comprising:

a frame;

a partition plate positioned to divide the frame into a plurality of ports; and an electromagnetic shielding elastic clip mounted on the partition plate and including:

a first elastic sheet disposed on a first side of the partition plate and having a base and a first passageway disposed at an end of the first elastic sheet opposite the base of the first elastic sheet; and a second elastic sheet disposed on a second side of the partition plate opposite the first side and having a base and a second passageway disposed at an end of the second elastic sheet opposite the base of the second elastic sheet, the base of the first elastic sheet and the base of the second elastic sheet form a U-shaped elastic clip, the second passageway is aligned with the first passageway, a diameter of the first passageway is larger than a diameter of the second passageway and an edge portion of the second passageway is bent onto an edge portion of the first passageway such that the edge portion of the second passageway and the edge portion of the first passageway are riveted to each other at an end of the electromagnetic shielding elastic clip opposite the U-shaped elastic clip.

11. The connector housing of claim 10, wherein the electromagnetic shielding elastic clip is formed of a single piece of a thin metal plate.

12. The connector housing of claim 11, wherein the electromagnetic shielding elastic clip is riveted and assembled together with the partition plate by a stamping die.

13. The connector housing of claim 10, wherein the U-shaped elastic clip is adapted to be clamped on an end of the partition plate.

14. The connector housing of claim 13, wherein the partition plate has a notch, the end of the first elastic sheet and the end of the second elastic sheet are each received in the notch.

* * * * *